US009353762B2

(12) United States Patent
Lang et al.

(10) Patent No.: US 9,353,762 B2
(45) Date of Patent: May 31, 2016

(54) PRESSURE COMPENSATING WET SEAL CHAMBER

(75) Inventors: John Lang, Inver Grove Heights, MN (US); Dan Beilke, Blaine, MN (US); Jeff Hermes, Shoreview, MN (US); Jared M. Krueger, Blaine, MN (US)

(73) Assignee: Pentair Flow Technologies, LLC, Delavan, WI (US)

( * ) Notice: Subject to any disclaimer, the term of this patent is extended or adjusted under 35 U.S.C. 154(b) by 595 days.

(21) Appl. No.: 13/333,765

(22) Filed: Dec. 21, 2011

(65) Prior Publication Data

US 2012/0163956 A1 Jun. 28, 2012

Related U.S. Application Data

(60) Provisional application No. 61/425,673, filed on Dec. 21, 2010.

(51) Int. Cl.
*F04D 29/10* (2006.01)
*F04D 29/12* (2006.01)

(52) U.S. Cl.
CPC ..... *F04D 29/106* (2013.01); *F04D 29/128* (2013.01)

(58) Field of Classification Search
CPC .... F04D 29/061; F04D 29/108; F04D 29/128
USPC ..... 415/111, 113, 230, 231
See application file for complete search history.

(56) References Cited

U.S. PATENT DOCUMENTS

| | | | | |
|---|---|---|---|---|
| 1,837,873 | A | 12/1931 | MacMeeken | |
| 2,698,584 | A * | 1/1955 | Stelzer | 415/26 |
| RE26,094 | E | 10/1966 | Zimmermann | |
| 3,741,679 | A | 6/1973 | Johnston | |
| 3,954,348 | A * | 5/1976 | Renaud | 415/113 |
| 4,013,384 | A | 3/1977 | Oikawa | |
| 4,214,436 | A | 7/1980 | Romehke et al. | |
| 4,269,566 | A | 5/1981 | Spruiell | |
| 4,278,402 | A | 7/1981 | Nielsen | |
| 4,289,445 | A * | 9/1981 | Sims | 415/113 |
| 4,384,820 | A | 5/1983 | Sims | |

(Continued)

FOREIGN PATENT DOCUMENTS

| | | | |
|---|---|---|---|
| EP | 0327844 | A2 | 8/1989 |
| EP | 0493428 | B1 | 11/1995 |
| WO | 2012088328 | A1 | 6/2012 |

OTHER PUBLICATIONS

International Preliminary Report on Patentability dated Jun. 25, 2013 and International Search Report dated Apr. 30, 2012 for related International Application No. PCT/US2011/066613, 9 pages.

(Continued)

*Primary Examiner* — Ninh H Nguyen
(74) *Attorney, Agent, or Firm* — Quarles & Brady LLP

(57) ABSTRACT

Some embodiments of the invention provide a pump including a pump chamber, a shaft at least partially positioned in the pump chamber, an impeller coupled to the shaft, and a seal coupled to the shaft. The pump also includes a wet seal chamber. The wet seal chamber can include a separator with a disc and a resilient member. The disc includes one or more slots through which fluid pressure from the pump chamber is transferred to the resilient member. The wet seal chamber substantially prevents fluid from contacting the seal in order to prolong a life of the seal.

22 Claims, 5 Drawing Sheets

(56) References Cited

U.S. PATENT DOCUMENTS

| | | | | |
|---|---|---|---|---|
| 4,410,187 | A | 10/1983 | Legoy et al. | |
| 4,502,834 | A | 3/1985 | Jackson | |
| 4,509,897 | A * | 4/1985 | Sims | 415/113 |
| 4,722,661 | A | 2/1988 | Mizuno | |
| 4,822,240 | A | 4/1989 | Marshall | |
| 4,828,454 | A | 5/1989 | Morris et al. | |
| 4,921,400 | A | 5/1990 | Niskanen | |
| 4,948,336 | A | 8/1990 | Mosure | |
| 5,076,589 | A | 12/1991 | Marsi | |
| 5,141,389 | A | 8/1992 | Bear et al. | |
| 5,169,286 | A | 12/1992 | Yamada et al. | |
| 5,211,530 | A | 5/1993 | Shiffler | |
| 5,211,532 | A | 5/1993 | Thompson | |
| 5,269,664 | A | 12/1993 | Buse | |
| 5,334,004 | A | 8/1994 | Lefevre et al. | |
| 5,340,272 | A | 8/1994 | Fehlau | |
| 5,525,039 | A | 6/1996 | Sieghartner | |
| 5,562,406 | A | 10/1996 | Ooka et al. | |
| 5,642,888 | A | 7/1997 | Rockwood | |
| 5,827,042 | A | 10/1998 | Ramsay | |
| 5,993,176 | A | 11/1999 | Kingsford et al. | |
| 6,325,602 | B1 | 12/2001 | Rademacher | |
| 6,533,540 | B1 | 3/2003 | Mathis | |
| 6,641,140 | B1 | 11/2003 | Matsumoto et al. | |
| 6,655,932 | B1 | 12/2003 | Stinessen et al. | |
| 6,981,359 | B2 | 1/2006 | Wernberg et al. | |
| 7,021,422 | B2 | 4/2006 | Busold et al. | |
| 7,096,658 | B2 | 8/2006 | Wernberg et al. | |
| 7,284,963 | B1 | 10/2007 | Houle | |
| 7,607,884 | B2 | 10/2009 | Cohen | |
| 2003/0198554 | A1 | 10/2003 | Ray et al. | |
| 2007/0140876 | A1 | 6/2007 | Parmeter et al. | |
| 2009/0191065 | A1 | 7/2009 | Binder et al. | |
| 2010/0111686 | A1 | 5/2010 | Burgess et al. | |

OTHER PUBLICATIONS

International Search Report dated Aug. 9, 2013 for related International Application No. PCT/US2013/036919, 2 pages.

* cited by examiner

PRESSURE COMPENSATING WET SEAL CHAMBER

CROSS REFERENCE TO RELATED APPLICATIONS

This application claims priority to U.S. Provisional Patent Application No. 61/425,673 filed Dec. 21, 2010 which is hereby incorporated by reference as if set forth in its entirety.

BACKGROUND

Centrifugal pumps typically include an impeller positioned in a pump chamber enclosed by a housing. The impeller is driven by a motor, which is mounted to the housing. A shaft connects the impeller and the motor. To seal a connection between the housing and the shaft, a seal is positioned on the shaft between the motor and the impeller.

The seal can be exposed to a fluid flowing through the pump chamber. Debris in the pumped fluid can reduce the lifespan of the seal. If the fluid is incompatible with the seal material, the seal may fail more rapidly. If the pump is running without pumping a fluid, the seal may overheat and fail.

SUMMARY

Some embodiments of the invention provide a pump including a pump chamber, a shaft at least partially positioned in the pump chamber, an impeller coupled to the shaft, and a seal coupled to the shaft. The pump also includes a wet seal chamber. The wet seal chamber can include a separator with a disc and a resilient member. The disc can include one or more slots through which fluid pressure from the pump chamber is transferred to the resilient member. The wet seal chamber substantially prevents fluid from contacting the seal in order to prolong a life of the seal.

DETAILED DESCRIPTION

Figure 1:
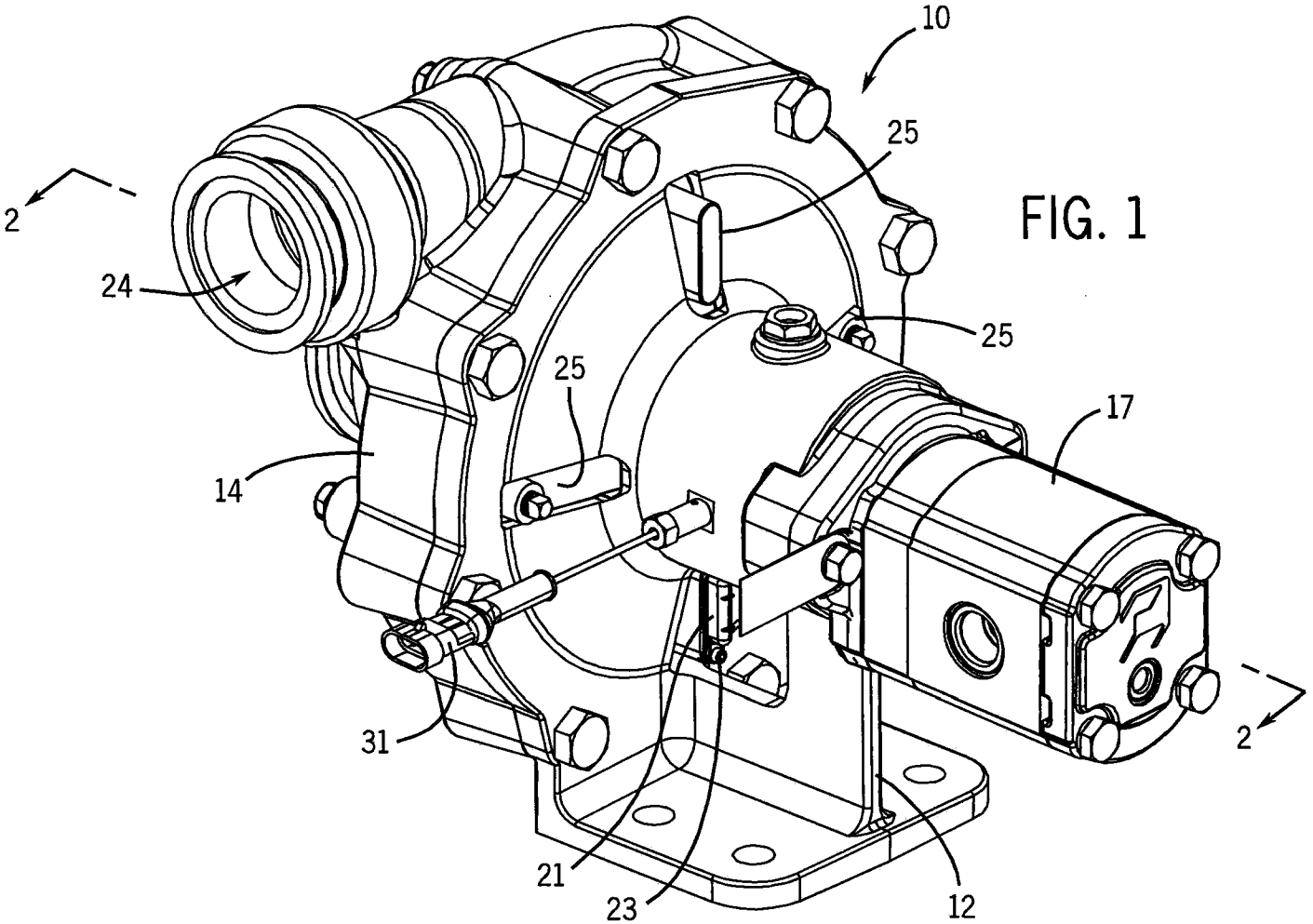
FIG. 1 is an isometric view of a pump according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 2:
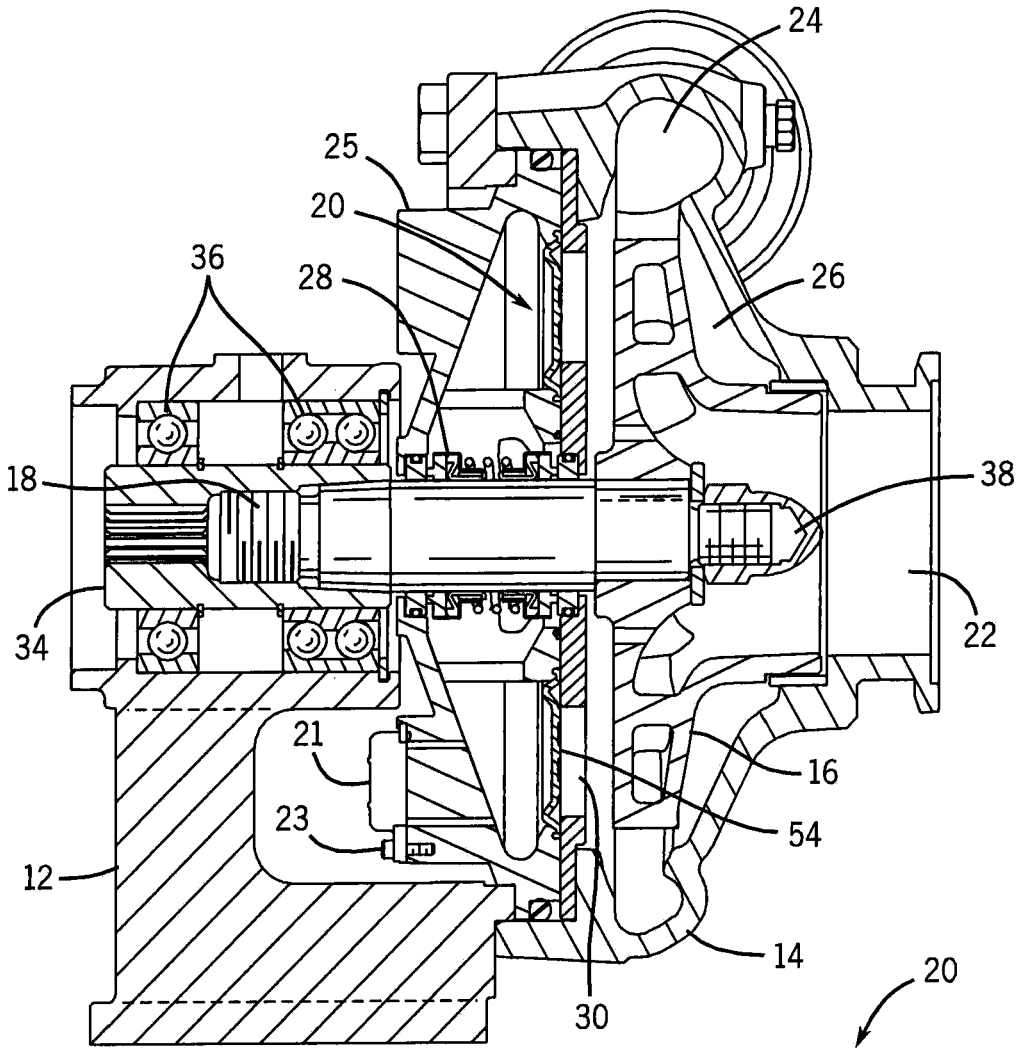
FIG. 2 is a cross-sectional view taken along lines 2-2 from FIG. 1, the motor not being shown.

FIGS. 1 and 2 illustrate a pump 10 according to one embodiment of the invention. The pump 10 can include a first housing portion 12, a second housing portion 14, an impeller 16, a shaft 18, and a wet seal chamber 20. In some embodiments, the wet seal chamber 20 can be coupled to the first housing portion 12 while, in other embodiments, the first housing portion 12 can integrally form at least a portion of the wet seal chamber 20. The second housing portion 14 can include an inlet 22, an outlet 24, and a pump chamber 26. The pump chamber 26 can enclose the impeller 16. The wet seal chamber 20 can include a seal 28, which can be coupled to the shaft 18. The seal 28 can seal a connection between the shaft 18 and the wet seal chamber 20. The wet seal chamber 20 can include a first fluid, such as, for example, a lubricant. The seal 28 can prevent the first fluid from leaking into first housing portion 12 and/or the pump chamber 26. The level of the first fluid in the wet seal chamber 20 may be verified using a sight window 21 installed on the back of the first housing portion 12 by a fastener 23. Not only does the fastener 23 attach the sight window 21 to the first housing portion 12, but the fastener 23 can also act as a vent to the wet seal chamber 20 when filling the wet seal chamber 20 with the first fluid. The sight window 21 can be installed in alternative mounting locations 25 (three shown in FIG. 1) depending on the orientation of the pump 10 in its end-user environment.

Figure 3:
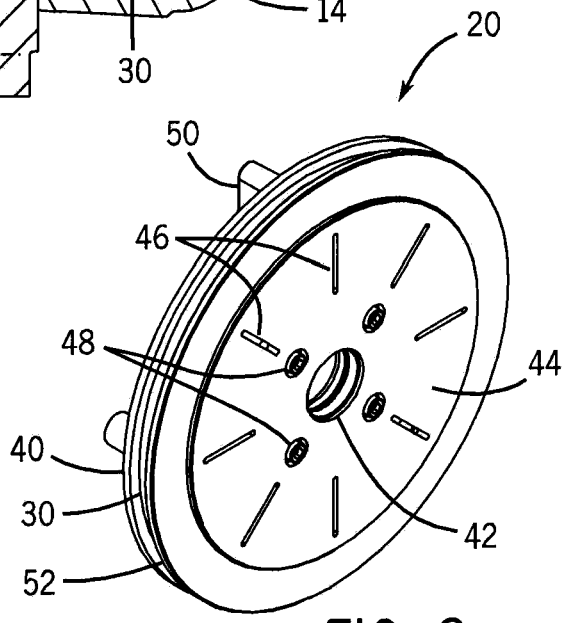
FIG. 3 is a perspective view of a wet seal chamber used in the pump of FIG. 1 according to one embodiment of the invention.
Figure 4:
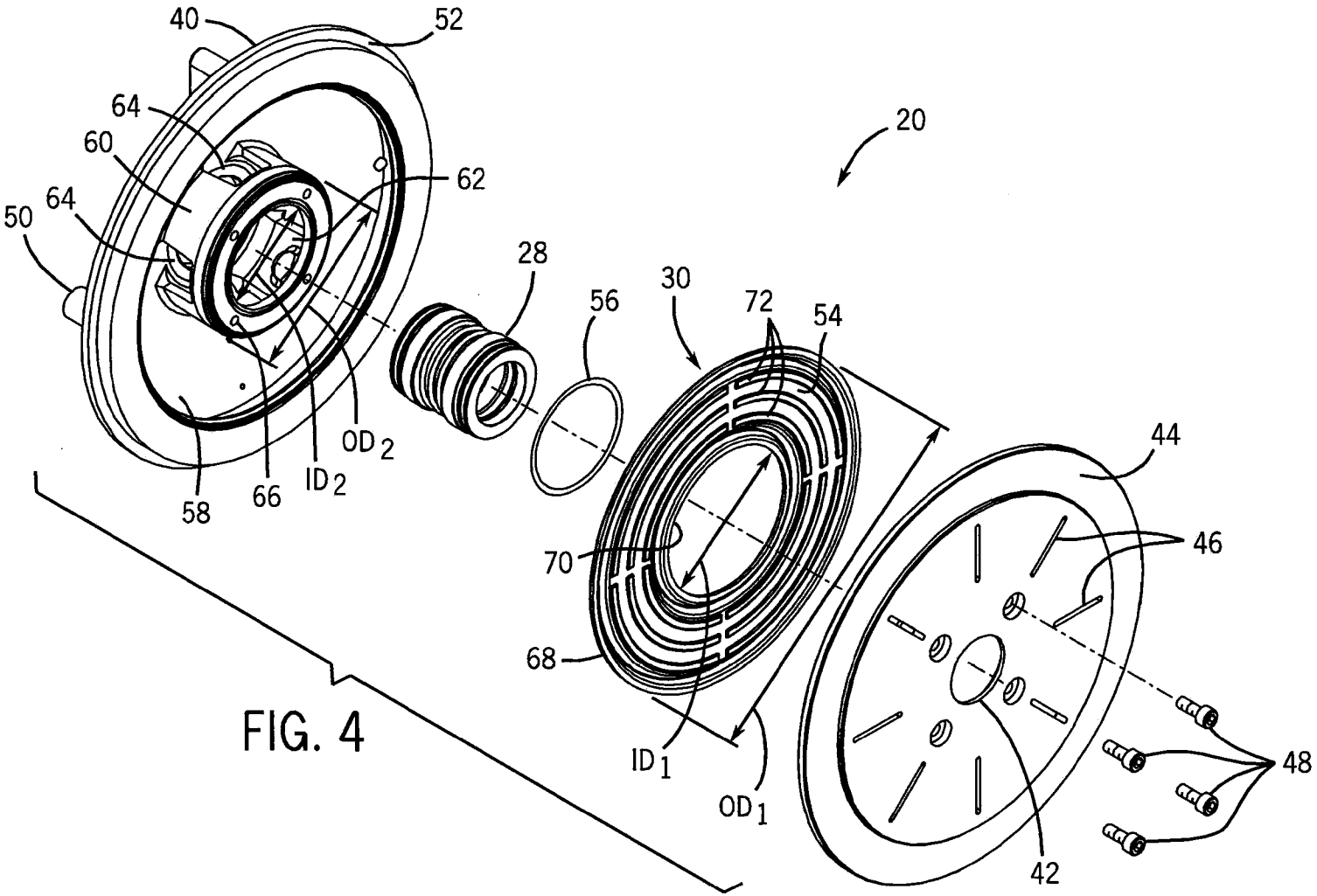
FIG. 4 is an exploded view of the wet seal chamber of FIG. 3.

As shown in FIGS. 2-4, a separator 30 can be positioned between the wet seal chamber 20 and the pump chamber 26. In some embodiments, the separator 30 can at least partially define the wet seal chamber 20 and the pump chamber 26. The separator 30 can be positioned adjacent to the impeller 16. In some embodiments, the separator 30 can be positioned substantially opposite the inlet 22. The separator 30 can be coupled to the first housing portion 12, the second housing portion 14, and/or the wet seal chamber 20. The second housing portion 14 can be removably coupled to the first housing portion 12. In some embodiments, the second housing portion 14 can be removed from the first housing portion 12 without detaching the impeller 16 and/or the separator 30.

As shown in FIG. 1, the impeller 16 can be driven by a motor 17. As also shown in FIG. 1, a speed sensor 31 can be used to collect data on the speed of the shaft 18 and other operating parameters of the motor 17. As shown in FIG. 2, the shaft 18 can be connected to a coupling 34 to connect the impeller 16 to the motor 17. The shaft 18 can be at least partially positioned in the pump chamber 26 and can extend through the separator 30 and the wet seal chamber 20. The shaft 18 and/or the coupling 34 can be rotatably coupled to the first housing portion 12 by bearings 36. The impeller 16 can be coupled to the shaft 18 by a contoured fastener 38. In some embodiments, the contoured fastener 38 can at least partly define a fluid flow path through the impeller 16.

FIG. 3 illustrates the wet seal chamber 20 according to one embodiment of the invention. The wet seal chamber 20 can include the separator 30, a back wall 40, and an opening 42. The separator 30 can include a disc 44, which can include one or more slots 46. Fasteners 48 can couple the disc 44 to the back wall 40. The back wall 40 can include a stud 50 to couple the wet seal chamber 20 to the first housing portion 12. A groove 52 can be formed between the separator 30 and the back wall 40. The groove 52 can receive a gasket (not shown) to seal a connection between the wet seal chamber 20 and the first housing portion 12 and/or the second housing portion 14.

FIG. 4 illustrates the wet seal chamber 20 and its internal components according to one embodiment of the invention. In one embodiment, the wet seal chamber 20 can be configured as a drop-in replacement item for the pump 10. The wet seal chamber 20 can include a resilient member 54 and an O-ring 56. In some embodiments, the resilient member 54 can be a diaphragm. The resilient member 54 can guide one or more pistons or plungers (not shown). The resilient member 54 can include a first outer diameter $OD_1$ and a first inner diameter $ID_1$. The back wall 40 can include a reservoir 58 and a flange 60. In some embodiments, the back wall 40 can be inclined and/or curved to form the reservoir 58. The flange 60 can be positioned within the reservoir 58 and can enclose an inner volume 62, which can at least partly receive the seal 28. The flange 60 can include apertures 64, which can enable fluid communication between the reservoir 58 and the inner volume 62. The flange 60 can include a second outer diameter $OD_2$ and a second inner diameter $ID_2$. The first inner diameter $ID_1$ of the resilient member 54 can be in contact with the second outer diameter $OD_2$ of the flange 60. The first outer diameter $OD_1$ of the resilient member 54 can be in contact with the back wall 40. The O-ring 56 can be coupled to the second inner diameter $ID_2$ of the flange 62. In some embodiments, the flange 60 can include holes 66 to receive the fasteners 48 in order to couple the disc 44 to the back wall 40. The slots 46 in the disc 44 can enable fluid communication between the pump chamber 26 and a space between the resilient member 54 and the disc 44. In some embodiments, the slots 46 can transfer a pressure from the pump chamber 26 onto the resilient member 54.

In some embodiments, the resilient member 54 can include a first convolute 68 and a second convolute 70. The first convolute 68 can be positioned adjacent to the first outer diameter $OD_1$ and the second convolute 70 can be positioned adjacent to the first inner diameter $ID_1$ . The first convolute 68 and/or the second convolute 70 can help the resilient member 54 to flex. If a pressure in the pump chamber 26 is higher than a pressure in the wet seal chamber 20, the first convolute 68 and/or the second convolute 70 can enable the resilient member 54 to bend toward the back wall 40. The resilient member 54 can decrease the volume of the reservoir 58 and can help direct the first fluid in the wet seal chamber 20 into the inner volume 62 of the flange 60. The resilient member 54 can form or include an impermeable membrane. As a result, the pressure in the vicinity of the seal 28 can be substantially higher than the pressure in the pump chamber 26 in the vicinity of the opening 42.

In some embodiments, the resilient member 54 can include one or more ribs 72. As shown in FIG. 4, the ribs 72 can be annular with respect to the resilient member 54; however, the ribs 72 can additionally or alternatively be formed radially with respect to the resilient member 54, or in other suitable configurations. The ribs 72 can be positioned between the first convolute 68 and the second convolute 70. In some embodiments, the ribs 72 can be substantially equally spaced along a perimeter of the resilient member 54. In some embodiments, the ribs 72 can prevent the resilient member 54 from blocking the slots 46, if the pressure in the wet seal chamber 20 is higher than in the pump chamber 26. As a result, the ribs 72 can help provide fluid communication of the pump chamber 26 with the space between the resilient member 54 and the disc 44.

Referring to FIG. 2, if the pump 10 is running, a second fluid can enter the pump chamber 26 through the inlet 22. The second fluid can be propelled toward the outlet 24 by the impeller 16. The pressure of the second fluid can increase while flowing from the inlet 22 to the outlet 24. In some embodiments, the pressure in the pump chamber 26 can increase in a radial direction away from the shaft 18. As a result, the pressure at an outer perimeter of the impeller 16 can be substantially higher than the pressure in the vicinity of the shaft 18. The pressure at the outer perimeter of the impeller 16 can also be substantially higher than the pressure in the wet seal chamber 20. To change the amount of force on the resilient member 24 based on the realized pressure differential between the fluid pressure in the pump chamber 26 and the pressure of the first fluid in the wet seal chamber 20, the size, design, and location of the slots 46 can be adjusted. Some of the second fluid can flow through the slots 46 and can deform the resilient member 24. The deformation of the resilient member 54 can increase the pressure in the wet seal chamber 20. As a result, the pressure in the vicinity of the shaft 18 and/or the seal 28 can be substantially higher in the wet seal chamber 20 than in the pump chamber 26. In some embodiments, the pressure in the wet seal chamber 20 can be substantially proportional to the pressure in the pump chamber 26. When the pump 10 is shut off and the pressure in the pump chamber 26 reduces, the resilient member 24 can decrease the pressure in the wet seal chamber 20 by deforming to increase the volume of the reservoir 58. Thus, one advantage of some embodiments of the pump 10 is that the pressure on the seal 28 in the wet seal chamber 20 can be both increased and decreased automatically based on the pressure of the second fluid in the pump chamber 26.

In some embodiments, the wet seal chamber 20 can prevent the second fluid from contacting the seal 28 and/or from penetrating into the wet seal chamber 20 through the opening 42. If the second fluid would be harmful to the seal 28 (e.g., the second fluid is an aggressive chemical), the wet seal chamber 20 can help increase the lifespan of the seal 28.

In some embodiments, the wet seal chamber 20 can be at substantially atmospheric pressure, if the pump 10 is not running. In other embodiments, the pressure in the wet seal chamber 20 can be slightly higher than atmospheric pressure, if the pump 10 is not running in order to help prevent fluid flow from the pump chamber 26 into the wet seal chamber 20, if the seal 28 fails. The wet seal chamber 20 will not be at a constant over-pressure, which is higher than the atmospheric pressure, which can assist in maintenance and can reduce accidents and/or injuries to a technician, if the pump 10 is being serviced and/or repaired.

If the pump 10 is running and no fluid is being pumped (dry-run condition), the first fluid in the wet seal chamber 20 can lubricate the shaft 18 and/or the seal 28. As a result, the set seal chamber 20 can increase the runtime of the pump 10 during dry-run conditions before the pump 10 fails due to overheating or other mechanical failures.

Figure 5:
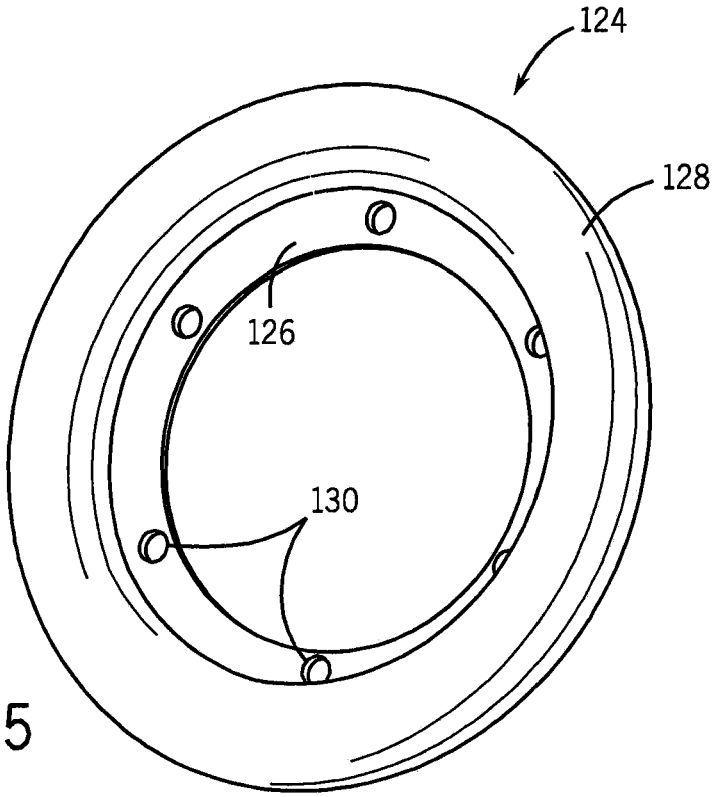
FIG. 5 is a perspective view of an alternate resilient member used in the wet seal chamber according to one embodiment of the invention.

FIG. 5 illustrates a resilient member 124 according to another embodiment of the invention. The resilient member 124 can include a ring 126 and a bladder 128. The ring 126 can include holes 130, which can be used to couple the resilient member 124 to the back wall 40. The bladder 128 can deform under pressure in the pump chamber 26 and can extend into the reservoir 58 in order to decrease the volume of the reservoir 58 and/or increase pressure in the wet seal chamber 20.

Figure 6:
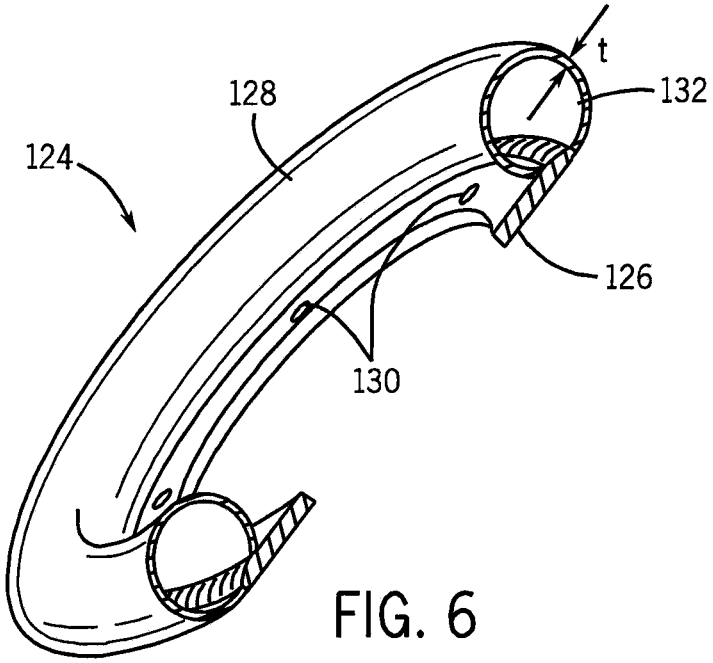
FIG. 6 is a cross-sectional perspective view of the resilient member of FIG. 5.

FIG. 6 illustrates a cross section of the resilient member 124 according to one embodiment of the invention. In some embodiments, the bladder 128 can be molded onto the ring 126. The bladder 128 can enclose a chamber 132. In some embodiments, the ring 126 can at least partly define the chamber 132. The chamber 132 can include a third fluid. The material of the bladder 128, a thickness t of the bladder 128, and/or the third fluid can determine the flexibility of the bladder 128. As a result, the material of the bladder 128, the thickness t of the bladder 128, and/or the third fluid can help transfer the pressure from the pump chamber 26 into the wet seal chamber 20.

Figure 7:
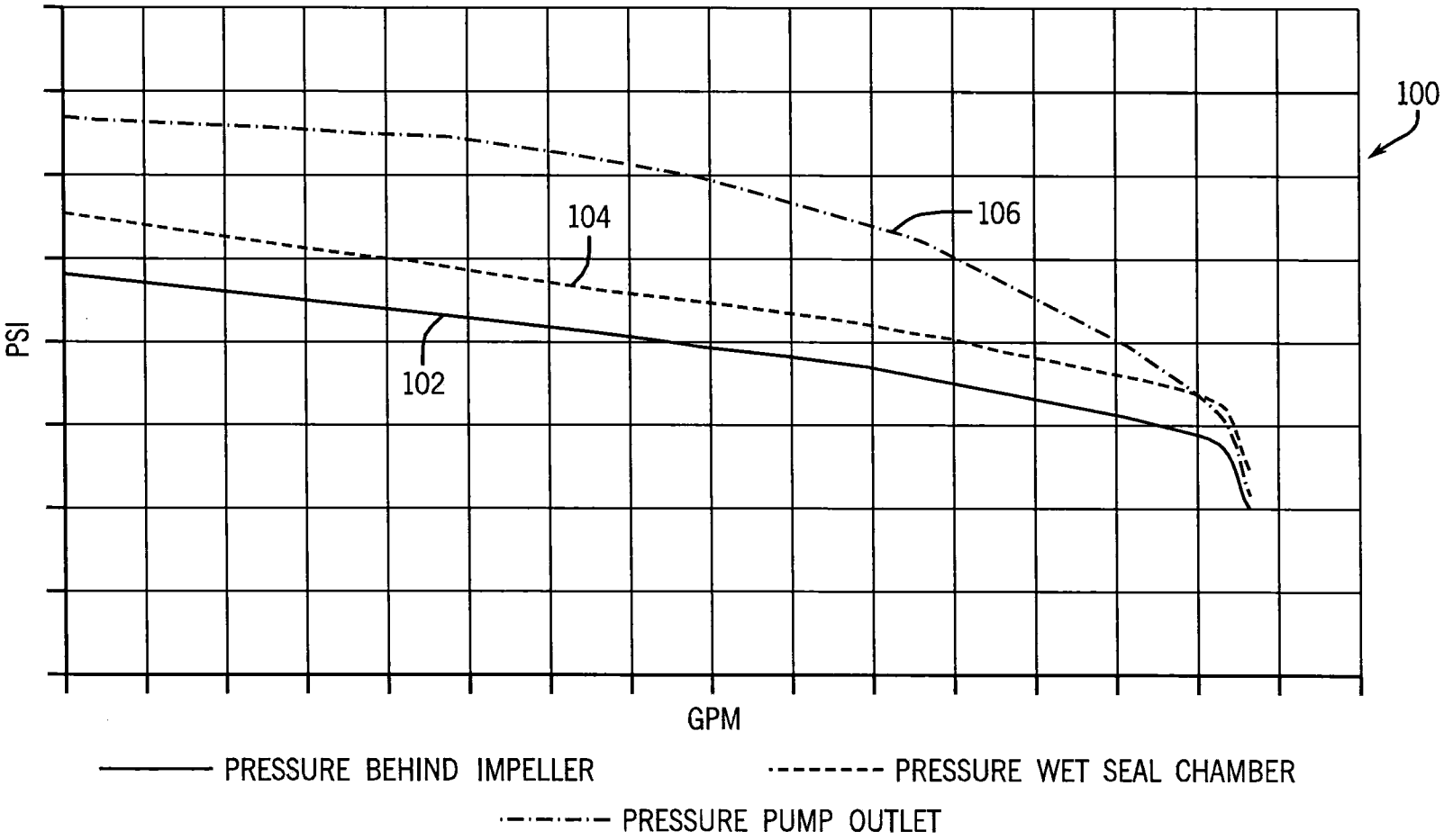
FIG. 7 is a graph of different pressure distributions over flow rate taken at different locations in the pump of FIG. 1.

FIG. 7 illustrates a pressure graph 100 including a first pressure distribution 102, a second pressure distribution 104, and a third pressure distribution 106 of the pump 10 according to one embodiment of the invention. The first pressure distribution 102 depicts a pressure taken behind the impeller 16 in the vicinity of the shaft 18 over a flow rate of the pump 10. The second pressure distribution 104 depicts a pressure in the wet seal chamber 20 over a flow rate of the pump 10. In some embodiments, the second pressure distribution 104 can always be higher than the first pressure distribution 102. In other embodiments, the second pressure distribution 104 can be higher than the first pressure distribution 102 over a certain range of flow rate. The third pressure distribution 106 depicts a pressure at the outlet 24 over a flow rate of the pump 10, which can be substantially higher than the first pressure distribution 102 and/or the second pressure distribution 104.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A pump comprising:

a pump chamber including an inlet and an outlet;

a shaft at least partially positioned in the pump chamber;

an impeller coupled to the shaft;

a seal coupled to the shaft; and a wet seal chamber, the wet seal chamber including a back wall and a separator spaced apart from the back wall, the separator including a disc and a resilient member, the back wall including a flange that extends toward the separator contacting the resilient member between the flange and the disc, the disc including at least one slot through which fluid pressure from the pump chamber is transferred to the resilient member, and the wet seal chamber substantially preventing fluid in the pump chamber from contacting the seal in order to prolong a life of the seal.

2. The pump of claim 1, wherein a first pressure in the wet seal chamber is higher than a second pressure at the inlet of the pump.

3. The pump of claim 1, wherein the wet seal chamber is positioned adjacent to the impeller.

4. The pump of claim 1, wherein the resilient member is a diaphragm.

5. The pump of claim 1, wherein the resilient member includes a bladder enclosing a fluid.

6. The pump of claim 1, wherein the resilient member decreases a volume of the wet sea chamber in order to increase a pressure in the wet seal chamber.

7. A pump comprising:

a pump housing having a first housing portion and a second housing portion that is removably coupled to the first housing portion;

a pump chamber including an inlet and an outlet;

a shaft at least partially positioned in the pump chamber;

an impeller coupled to the shaft, the impeller residing in the pump chamber;

a seal coupled to the shaft; and a wet seal chamber positioned between the first housing portion and the second housing portion defining a reservoir for holding a first fluid having a first fluid pressure, the wet seal chamber including a separator for separating the wet seal chamber from the pump chamber, the separator including a resilient member that adjusts to increase the first fluid pressure by reducing a volume of the reservoir upon a second fluid pressure in the pumping chamber being greater than the first fluid pressure in the reservoir.

8. The pump of claim 7, wherein the first fluid pressure is higher than the second fluid pressure.

9. The pump of claim 7, wherein the separator further includes a disc, the disc including at least one slot through which the second fluid pressure from the pump chamber is transferred to the resilient member.

10. The pump of claim 9, wherein the resilient member includes at least one rib to inhibit the resilient member from blocking the at least one slot.

11. The pump of claim 7, wherein the resilient member is non-integral with the pump housing.

12. The pump of claim 7, wherein the resilient member includes a diaphragm.

13. The pump of claim 7, wherein the resilient member includes a ring and a bladder, the bladder enclosing a third fluid.

14. The pump of claim 13, wherein the bladder is molded onto the ring.

15. The pump of claim 7, wherein the resilient member includes an impermeable membrane.

16. The pump of claim 7, wherein the resilient member adjusts to decrease the first fluid pressure by increasing a volume of the reservoir upon the second fluid pressure in the pumping chamber being less than the first fluid pressure in the reservoir.

17. A wet seal chamber for a pump, the pump including a first housing portion and a second housing portion having an inlet, an outlet and a pump chamber, the pump including a shaft at least partially positioned in the pump chamber, and an impeller coupled to the shaft, the wet seal chamber comprising:

a separator including a disc and a resilient member;

a seal for coupling to the shaft; and a back wall;

the resilient member and the back wall defining a reservoir for enclosing a first fluid having a first fluid pressure, the separator positioned between the pump chamber having a second fluid and the reservoir, the resilient member being deformable to increase the first fluid pressure by reducing a volume of the reservoir, and the wet seal chamber positionable between the first housing portion and the second housing portion as a drop-in replacement for the pump.

18. The wet seal chamber of claim 17, wherein the resilient member deforms when a second fluid pressure of the second fluid in the pumping chamber is greater than the first fluid pressure of the first fluid in the reservoir.

19. The wet seal chamber of claim 18, wherein the disc includes at least one slot through which the second fluid pressure from the pump chamber is transferred to the resilient member.

20. The wet seal chamber of claim 19, wherein the resilient member includes at least one rib to inhibit the resilient member from blocking the at least one slot.

21. The wet seal chamber of claim 17, wherein the resilient member includes a diaphragm.

22. The wet seal chamber of claim 17, wherein the resilient member includes a bladder enclosing a third fluid.

* * * * *